US009427096B2

(12) United States Patent
Subu

(10) Patent No.: US 9,427,096 B2
(45) Date of Patent: Aug. 30, 2016

(54) CONTAINER ORGANISER

(76) Inventor: Johnny George Subu, Livonia, MI (US)

( * ) Notice: Subject to any disclaimer, the term of this patent is extended or adjusted under 35 U.S.C. 154(b) by 934 days.

(21) Appl. No.: 13/444,872

(22) Filed: Apr. 12, 2012

(65) Prior Publication Data

US 2013/0015196 A1 Jan. 17, 2013

(30) Foreign Application Priority Data

Jul. 15, 2011 (GB) ..... 1112167.0

(51) Int. Cl.

*A47F 7/00* (2006.01)
*A47F 1/12* (2006.01)
*A47F 3/04* (2006.01)

(52) U.S. Cl.

CPC ..... *A47F 1/12* (2013.01); *A47F 3/0486* (2013.01)

(58) Field of Classification Search

CPC ..... A47F 3/0486; A47F 1/12
USPC ..... 221/1, 92, 288, 5, 59.3; 211/49.1, 59.2, 211/74

See application file for complete search history.

(56) References Cited

U.S. PATENT DOCUMENTS 1,885,110 A * 11/1932 Hulbert ..... 137/103
2,943,730 A * 7/1960 Tregilgas ..... B65D 83/0454 116/308
3,018,149 A * 1/1962 Parker ..... A47B 81/007 116/303
3,435,833 A * 4/1969 Tanaka ..... G07D 1/00 221/155
3,501,016 A * 3/1970 Eaton ..... A47F 7/28 211/49.1
4,501,283 A * 2/1985 Webb ..... A24F 23/00 131/329
4,742,936 A * 5/1988 Rein ..... A47F 1/126 116/278
4,874,348 A * 10/1989 Lafreniere ..... G07D 1/08 221/281
5,129,546 A * 7/1992 Thielmann ..... B65D 83/04 206/704
5,366,113 A * 11/1994 Kim et al. ..... 221/232
5,819,937 A * 10/1998 Walker ..... 206/429
5,863,431 A * 1/1999 Salzburg ..... A47J 31/08 206/0.5
5,865,324 A * 2/1999 Jay ..... A47F 7/28 211/59.2
6,502,408 B1 * 1/2003 Corcoran ..... 62/63
7,823,733 B2 * 11/2010 Futori ..... 211/59.2

(Continued)

FOREIGN PATENT DOCUMENTS

CA 1327032 C 2/1994
DE 19803985 A1 8/1999

(Continued)

OTHER PUBLICATIONS

International Search Report of PCT Patent Application No. PCT/IB2012/001377 issued on Nov. 20, 2012.
Search Report of British Patent Application No. GB1112167.0 issued on Oct. 29, 2011.

*Primary Examiner* — Rakesh Kumar

(57) ABSTRACT

A container organizer comprises a base element and a perimeter wall which extends from the base element. The base element and the perimeter wall define an enclosure for the insertion of a plurality of containers. An intermediate wall divides the enclosure into first and second channels. The intermediate wall extends from the base element and is spaced from the perimeter wall at at least one end. The said space is dimensioned to allow the said container to pass between the first and second channels. A plurality of inventory indicators are included, whereby as containers are moved along at least the first channel the inventory indicators indicate a number of replacement containers that can be inserted. Preferably, the base element includes an embankment portion at a space between the end of the intermediate wall and the perimeter wall.

8 Claims, 3 Drawing Sheets

(56) References Cited

U.S. PATENT DOCUMENTS

| | | | | |
|---|---|---|---|---|
| 7,971,960 | B2 * | 7/2011 | Silverbrook | B41J 2/14427 347/40 |
| 2005/0168345 | A1 | 8/2005 | Swafford et al. | |
| 2009/0212066 | A1 | 8/2009 | Bauer | |
| 2010/0295424 | A1 | 11/2010 | Alexander | |
| 2013/0015196 | A1 * | 1/2013 | Subu | 221/1 |

FOREIGN PATENT DOCUMENTS

| | | | |
|---|---|---|---|
| GB | 2275181 | A | 8/1994 |
| GB | 2324597 | A | 10/1998 |
| JP | 2011056021 | A | 3/2011 |
| WO | 9908950 | A1 | 2/1999 |
| WO | 9958915 | A1 | 11/1999 |

* cited by examiner

CONTAINER ORGANISER

This application claims priority to UK patent application 1112167.0, filed on Jul. 15, 2011, the disclosure of which is incorporated herein by reference in its entirety.

BACKGROUND OF THE INVENTION

1. Field of the Invention

The present invention relates to a container organizer, and to a refrigeration device having such a container organizer therein, and to a method of manually arranging a plurality of containers in chronological order using such a container organizer.

2. Description of the Prior Art

Presently, containers such as tin, cans, bottles and packets are organised generally randomly on a shelf within a shop or at home. Occasionally a member of staff will reorder the containers so that the older ones are closer to the front in an effort for customers to take these first. More particularly, such containers are only notionally at best organised logically within a refrigerator, such as a cooler behind a bar of a pub, café or restaurant. When new bottles, for example, are taken from storage to restock the cooler, they are more often than not placed within the cooler in no particular order. This is largely due to time pressures of the staff. Furthermore, particularly in domestic settings, there is no order to the insertion of bottles or other containers into a fridge or onto a shelf in a cupboard or pantry. Particularly with a fridge, it is therefore often difficult to determine which items are suitably chilled or older, and which items have only recently been inserted and thus may still not be suitably cooled.

The present invention seeks to provide a solution to these problems.

SUMMARY OF THE INVENTION

According to a first aspect of the invention, there is provided a container organizer comprising a base element and a perimeter wall which extends from the base element, the base element and the perimeter wall defining an enclosure for the insertion of a plurality of containers, and an intermediate wall which divides the enclosure into first and second channels, the intermediate wall extending from the base element and being spaced from the perimeter wall at at least one end, the said space being dimensioned to allow the said container to pass between the first and second channels, and a plurality of inventory indicators provided on at least one of the perimeter wall and the intermediate wall. As containers are moved along at least the first channel, the inventory indicators indicate a number of replacement containers that can be inserted. A stockist can thus determine accurately how many replacement containers are required without trial and error. The exact number of replacement containers can be brought out from stock, thus dispensing with the need for any return trips.

According to a second aspect of the invention, there is provided a method of arranging a plurality of containers in chronological order, whereby the first container to be inserted becomes the first container to be extracted, the method comprising the steps of providing a container organizer in accordance with the first aspect of the invention, wherein the first and second channels are of sufficient width to only accept containers in single file, feeding a plurality of containers into the first channel, whereby the addition of further containers causes the leading containers to slide through the said space defined between the intermediate wall and the perimeter wall and thus pass into the second channel, the introduction of the said further containers causing contra linear movement of the containers in the first and second channels, wherein the leading container is presented for first use at an end of the second channel and once removed from the container organizer a replacement container is urged into the second channel thus causing the plurality of containers to travel along the first and second channels thereby presenting for use a new leading container at the end of the second channel.

Preferably, the containers are beverage containers.

According to a third aspect of the invention, there is provided a container organizer comprising a base element and a perimeter wall which extends from the base element, the base element and the perimeter wall defining an enclosure for the insertion of a plurality of containers, and an intermediate wall which divides the enclosure into first and second channels, the intermediate wall extending from the base element and being spaced from the perimeter wall at at least one end, the said space being dimensioned to allow the said container to pass between the first and second channels, and an embankment portion at the space between the end of the intermediate wall and the perimeter wall, whereby the containers tilt as they transition between the first and second channels.

The invention will now be more particularly described, by way of example only, with reference to the accompanying drawings.

DETAILED DESCRIPTION OF THE PREFERRED EMBODIMENTS

Figure 1:
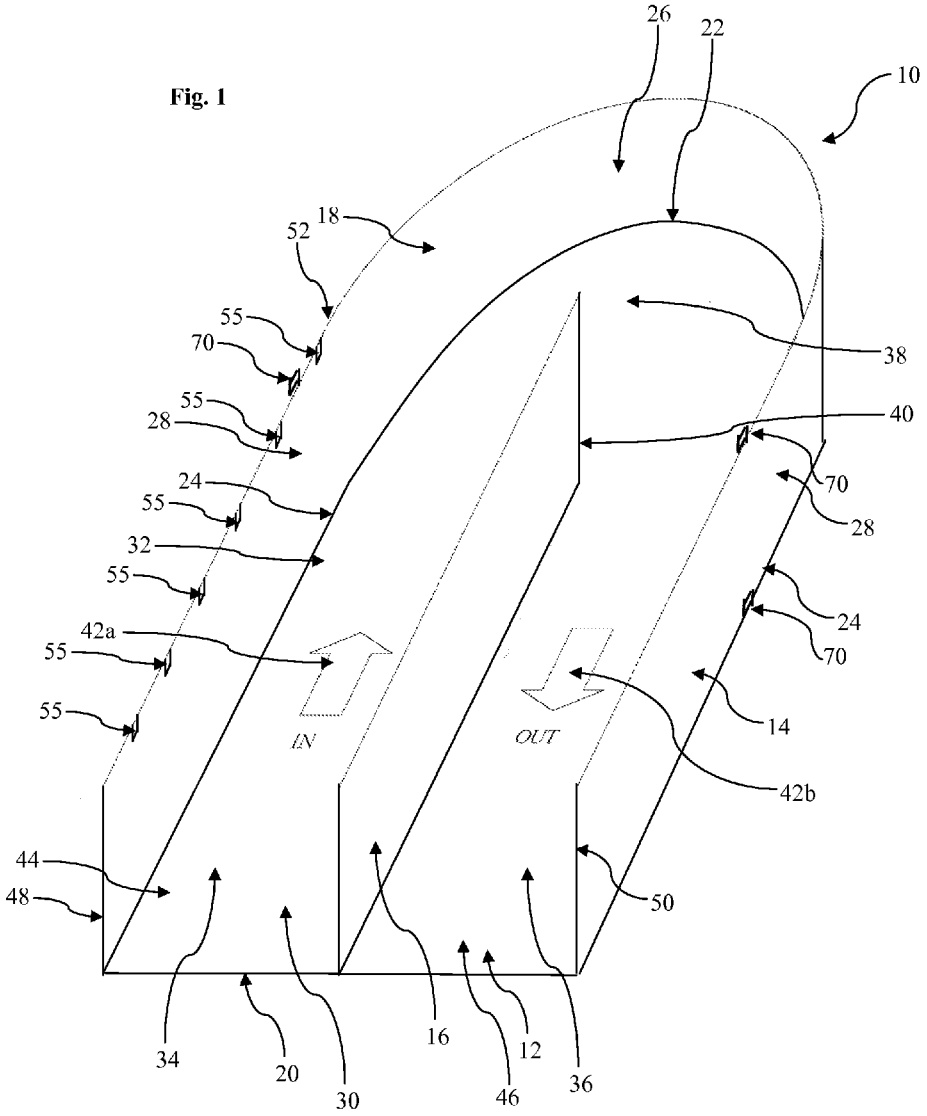
FIG. 1 shows a diagrammatic perspective view of a first embodiment of a container organizer, in accordance with the first aspect of the invention.
Figure 2:
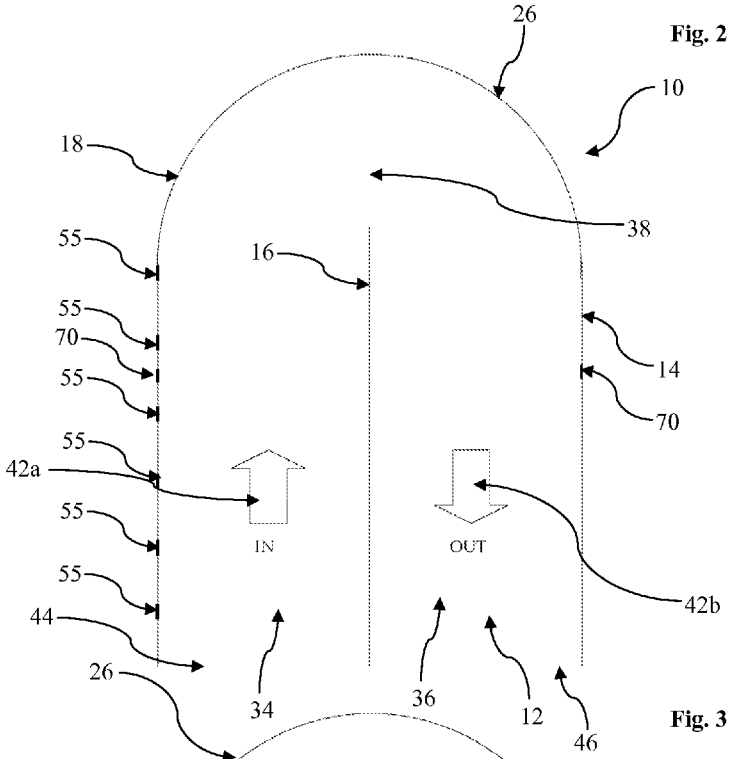
FIG. 2 shows a plan view of the container organizer, as shown in FIG. 1.

Referring firstly to FIGS. 1 and 2 of the drawings, there is shown a first embodiment of a container organizer 10 that comprises a rigid base 12 which is preferably generally planar along at least a majority of its longitudinal extent, forming a main supporting surface for holding a plurality of containers, such as bottles, a perimeter wall 14 and an intermediate wall 16. The container organizer 10 may be formed of plastics or metal. Preferably, the container organizer 10 especially if it is to be used in a refrigeration device, such as a fridge or cooler, is formed of a material having a high thermal conductivity. One such material may be aluminium. This would be highly beneficial as the container organizer 10 would thus act as a heat exchanger enabling more rapid cooling of the containers placed thereon by the dissipation of heat to the contacting base 12, perimeter wall 14 and/or intermediate wall 16.

The perimeter wall 14 is rigid and extends around a perimeter edge of the base 12. In this case, the base 12 is substantially rectangular with an arcuate distal portion 18, but other shapes are envisaged, such as multi-faceted. The perimeter wall 14 upstands from the base 12, and in use is substantially vertical relative to the horizontal base 12. The base 12 provides a front edge 20, back edge 22, and two opposing side edges 24 interconnecting the front and back edges 20, 22. Preferably, the back edge 22 is fully arcuate or curved whereby in conjunction with a curved back wall portion 26 of the perimeter wall 14 the aforementioned arcuate distal portion 18 is formed.

The perimeter wall 14 extends along the opposing side edges 24 of the base 12, and is substantially flat, providing side wall portions 28. The side wall portions 28 are parallel or substantially parallel with each other.

The perimeter wall 14 terminates at or adjacent to the front edge 20 of the base 12, providing a substantially open proximal portion 30.

The intermediate wall 16 is also rigid, upstands from the base 12 and extends at least substantially in parallel with the side wall portions 28 of the perimeter wall 14. The perimeter wall 14 and the base 12 define an enclosure 32 which in this case is open at one end and across the top, and the intermediate wall 16 divides or partitions the enclosure 32 into, in this case substantially equal, first and second container channels 34, 36. The intermediate wall 16 may have a height which is substantially the same as or less than that of the perimeter wall 14.

To this end, the intermediate wall 16 extends from or adjacent to the front edge 20 of the base 12 and terminates spaced from the curved back wall portion 26. The gap 38 provided between a distal edge 40 of the intermediate wall 16 and the curved back wall portion 26 is dimensioned to enable a container to pass therethrough from the first channel 34 to the second channel 36 unhindered.

The first and second container channels 34, 36 are at least substantially of the same dimensions, and in this case are at least substantially rectilinear from the front edge 20 of the base 12 to or adjacent to the arcuate distal portion 18. Consequently, a lateral cross-section of the first and second channels 34, 36 is uniform or substantially uniform along at least a majority of the respective longitudinal extents.

The container organizer 10 also preferably includes a directional indicator 42*a* for indicating an entrance 44 to the said enclosure 32, and preferably also a directional indicator 42*b* for indicating an exit 46 from the said enclosure 32. The or each directional indicator 42*a*, 42*b* may be one or more signs or indicia such as one or more directional arrows identifying an intended movement path along the first and/or second channels 34, 36. In this case, the or each arrow may be printed or more preferably engraved on a surface of at least the first channel 34 at or adjacent to the front edge 20 of the base 12.

Additionally or alternatively, the directional indicator 42*a*, 42*b* may be or include a tonal contrast to indicate the entrance 44 and/or exit 46. For example, a leading edge 48 of the perimeter wall 14 on one side portion and/or the intermediate wall 16 defining the lateral opening to the first channel 34 may be coloured to indicate the entrance 44, for example, red to indicate heat. Similarly, a leading edge 50 of the perimeter wall 14 on the other side portion and/or the intermediate wall 16 defining the lateral opening to the second channel 36 may be coloured to indicate the exit 46, for example, blue to indicate cold.

Any other suitable directional indicator or combination of directional indicators may be utilised.

A plurality of inventory indicators 55 are provided on at least one of the perimeter wall and the intermediate wall. In this embodiment, a row of spaced apart inventory indicators 55 are provided in an upper free edge of the perimeter wall 14 defining the first channel 34. The spacing apart of the inventory indicators 55 is preferably dimensioned to match or substantially match a diameter of a container which will be accommodated by the first channel 34. As such, the spacing apart of the inventory indicators 55 is or approximates to the lateral extent of the first channel 34.

Each inventory indicator in this embodiment is a notch in the upper free edge of the perimeter wall 14. However, other forms of inventory indicator can be utilised, such as for example a projection, pin or tab, a marker embossed on the outside and/or inside of the perimeter wall, and/or a marker on the base 12.

The inventory indicators 55 are advantageous in that, as containers are moved along at least the first channel 34, a number of replacement containers that can be inserted is clearly indicated. It is therefore a simple matter of a stockist to determine exactly a number of replacement containers required without any trial and error. A precise number of replacement containers can be brought out from stock, thus dispensing with the need for any return trips.

Beneficially, the inventory indicators 55 are viewable from an exterior side of the perimeter wall 14 and an interior side of the perimeter wall 14. This enables a user or stockist to determine a maximum number of new containers from any direction.

A further advantage realized by having the inventory indicators 55 on or adjacent to an upper free edge of the perimeter wall 14 and/or on the base 12 is that a user can also clearly determine from above a number of replacement containers required.

Preferably, a depth of the defined enclosure 32 may be suitable to receive a height of the containers fully within the first and second channels 34, 36. This is beneficial in allowing stacking of like or similar container organisers. To this end, engagement means 70 is preferably provided at or adjacent to top edges 52 of the perimeter wall 14 and/or the intermediate wall 16, and in the lower surface of the base 12 to allow for interengagement between stacked container organisers 10.

By way of example, the engagement means 70 may be one or more projecting bosses or spigots on or adjacent to the perimeter wall 14 and/or intermediate wall 16, and complementarily shaped recesses in the bottom surface of the base 12, or vice versa. Push fit interengagement is thus possible by stacking. Additionally or alternatively, a key or keys may be formed along a top edge 52 of the perimeter wall 14 and/or intermediate wall 16, and complementarily shaped keyways may be formed in the bottom surface of the base 12, or vice versa. Sliding interengagement is thus possible to achieve stacking.

With the container organizer 10 in use, for example in a refrigerator, a plurality of containers such as beverage bottles, cans or tins, are fed in a normal upright condition into the first channel 34 through the entrance 44 which is denoted by the directional indicator 42*a*. The first and second channels 34, 36 preferably have a lateral extent which is only just greater than that of the containers, and as such the containers are fed in one at a time and assume a single file arrangement within the first channel 34.

As further containers are fed through the entrance 44 and into the first channel 34, the existing containers are forced along the first channel 34. On reaching the arcuate distal portion 18, the containers slide around the curved back wall portion 26, through the gap 38 and into the second channel 36. The containers in the second channel 36 then move in the opposite direction to those in the first channel 34, as more containers are pushed through the entrance 44 into the first channel 34.

Once the leading container reaches the exit 46 at the end of the second channel 36, further containers are not pushed into the first channel 34.

The leading container at the exit 46 of the second channel 36 will therefore be, in chronological terms, the oldest since it was the first to be inserted into the first channel 34. In this case, it will therefore be the most chilled. The second directional indicator 42*b*, if utilised, indicates that containers should be extracted from the exit 46 at the second channel 36. Once the leading container or containers is/are extracted for use, a further container or containers from stock is/are retrieved. The number of new containers required is easily determined by the inventory indicators 55. The new containers are pushed into the first channel 34 in accordance with the directional indicator 42*a*. The trailing container or containers just from stock is/are therefore newer and thus warmer. The insertion of the trailing container(s) causes the new leading container in the second channel 36 to be slid forwards to the exit 46. This container will be cooler since it has been in the container organizer 10 for a longer period of time.

By ordering the containers using the container organizer 10, and especially during restocking, it becomes readily apparent which containers are older and thus in this case more likely to be colder. It is these containers that are more suitable for immediate consumption.

A similar method can be employed on the shelf of a store or in the home for other kinds of container which perhaps do not require chilling. In this case, the container organizer 10 is beneficial in that the older containers are automatically moved towards the exit 46 of the second channel 36 as newer stock is introduced through the entrance 44 into the first channel 34.

The first and second container channels 34, 36, although coplanar or substantially coplanar in the above embodiment, one or both may be sloped to encourage sliding movement along the defined path. In this case, the first container channel 34 would slightly sloped towards the arcuate distal portion 18, and the second channel 36 would be slightly sloped towards the exit 46. Alternatively or additionally, the sloping would be in the lateral extent, for example, from the perimeter wall 14 to the intermediate wall 16. This slight tilting of the containers towards one wall 14, 16 aids rolling movement of the containers along the channels 34, 36.

Figure 3:
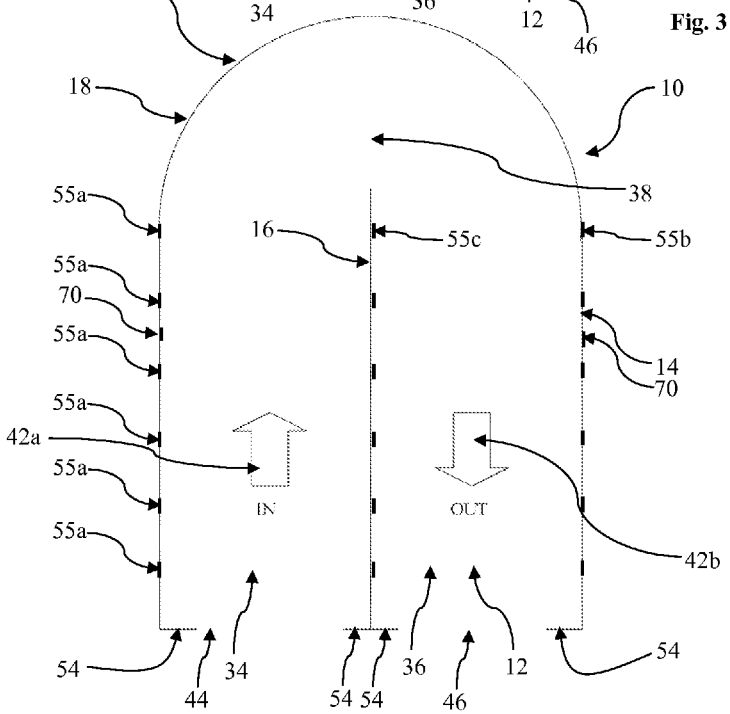
FIG. 3 shows a plan view of a second embodiment of a container organizer, in accordance with the first aspect of the invention.

Referring now to FIG. 3, there is shown a second embodiment of a container organizer. Like references refer to parts which are similar to those of the first embodiment, and therefore further detailed description is omitted. The container organizer 10 of this embodiment again includes the base 12 and perimeter wall 14 defining the enclosure 32, the intermediate wall 16 which divides the enclosure 32 to define the first and second channels 34, 36, and inventory indicators 55*a* in this case on the perimeter wall 14 of the first channel 34, inventory indicators 55*b* on the perimeter wall 14 of the second channel 36, and inventory indicators 55*c* on the intermediate wall 16.

The container organizer 10 also includes a plurality of baffles 54, two at the entrance 44 and two at the exit 46. The baffles 54 are preferably flexible strips which extend from or adjacent to the base 12 and along the leading edges 48, 50 of the perimeter wall 14 and the intermediate wall 16. For example, the baffles 54 may be rubber strips.

The baffles 54 are beneficial in preventing or inhibiting containers accidentally or unintentionally falling out of the entrance 44 and exit 46.

Although baffles 54 are provided on both sides of the entrance 44 and exit 46, the baffles 54 may only be provided on the exit 46, since a container is more likely to be pushed inadvertently out of the second channel 36. Additionally or alternatively, only one baffle 54 may be provided either on one of the first and second channels 34, 36 or on both the first and second channels 34, 36.

Figure 4:
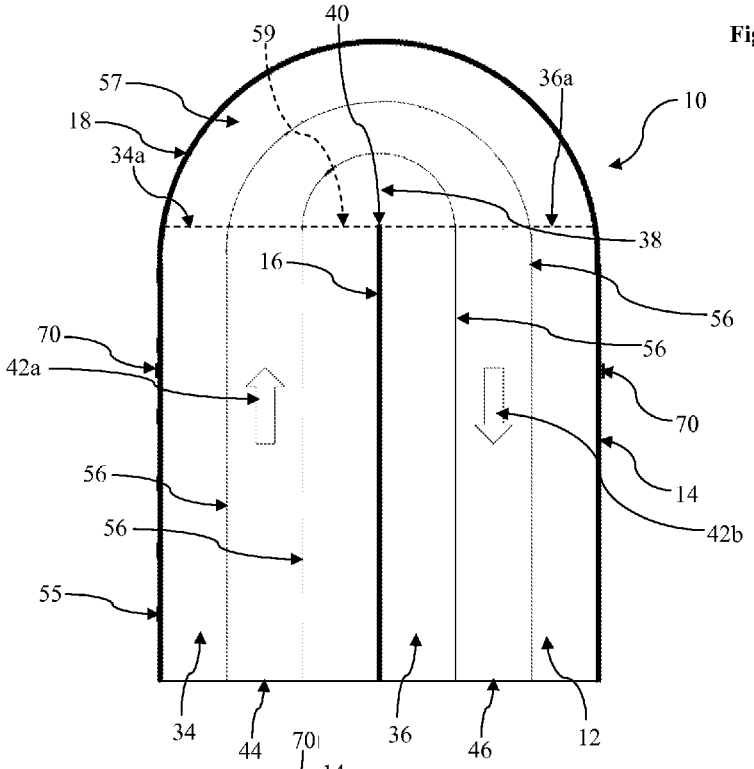
FIG. 4 shows a plan view of a third embodiment of a container organizer, in accordance with the first and third aspects of the invention.

Referring to FIG. 4, a third embodiment of a container organizer will now be described. Again, like references refer to parts which are similar to those of the first embodiment, and therefore further detailed description is omitted. The container organizer 10 of this embodiment includes the base 12 and perimeter wall 14 defining the enclosure 32, the intermediate wall 16 which divides the enclosure 32 to define the first and second channels 34, 36, and the inventory indicators 55.

To prevent or inhibit unrestricted sliding movement of containers within the first and second channels 34, 36, a friction rail or strip 56 is provided along the first and second channels 34, 36 and around the arcuate distal portion 18. The friction strip 56 is provided on the base 12. Although only one friction strip 56 may be provided, in this case two friction strips 56 are utilised. The friction strips 56 preferably extend in parallel spaced relationship relative to each other and with the perimeter wall 14 and intermediate wall 16.

The friction strips 56 are formed of a material having a higher coefficient of friction than the base 12, and for example may be rubber or plastics.

Although preferably provided on the base 12, the, each or a further friction strip may be provided on one or both of an inner surface of the perimeter wall 14 and the intermediate wall 16. In this case, the friction strip 56 acts as a rubbing strip or buffer against which the containers contact.

Although preferable, the friction strips 56 may be utilised simply as projecting spacer rails or strips and thus formed of the same or similar material as the base 12. In this case, it is advantageous that the spacer strips 56 are integrally moulded as one-piece with the base 12.

The spacer strips 56 are beneficial in spacing a base of a container away from the surface of the base 12. This provides for an air-gap between the base of the container and the base 12, thus promoting evaporative cooling and a reduction in potential condensation build up during refrigeration of a warm or room temperature container. Hygiene is thus improved.

Additionally, by forming the spacer strips 56 of the same material as the base 12, a reduction in friction is achieved, which in some cases may be preferred thereby allowing easier sliding movement of the containers in the first and second channels 34, 36.

In this embodiment, an embankment 57 is provided at the gap 38, formed as a portion of the base 12. The embankment 57 extends from or adjacent to an end 34*a* of the first channel 34 to or adjacent to an end 36*a* of the second channel 36. This is denoted by a dotted line 59 in FIG. 4.

The embankment 57 in this case is slight, causing the containers to tilt in towards the end 40 of the intermediate wall 16 as they approach, pass through and depart from the gap 38. This tilting aids movement of the containers, leading to less likelihood of binding and jamming.

In a modification, the baffles 54 and the friction strips 56 may be used together.

Although the arcuate distal portion 18 is preferably continuously curved, it may include a straight or rectilinear portion intermediate two curved portions.

Figure 5:
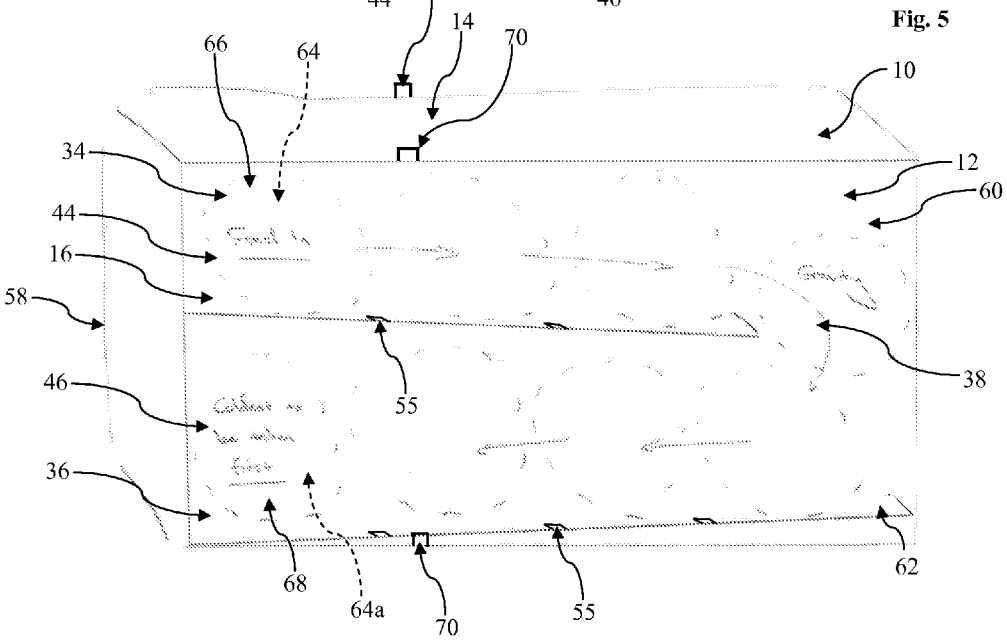
FIG. 5 shows a diagrammatic perspective view of a fourth embodiment of a container organizer, in accordance with the first aspect of the invention.

FIG. 5 shows a fourth embodiment of a container organizer. Like references refer to parts which are similar to those of the first embodiment, and therefore further detailed description is omitted. The container organizer 10 comprises a major upright wall forming a base element 12 from which the perimeter wall 14 extends continuously therearound to define the enclosure 32. The intermediate wall 16 divides the enclosure 32 as before, but in this case slopes from a first side edge 58 of the base element 12 to a position adjacent to an opposing second side edge 60. As before, a gap 38 is provided between the end of the intermediate wall 16 and the second side edge 60 for a container to pass through, and inventory indicators 55 are included.

A lower wall portion 62 of the perimeter wall 14 is also sloped in the opposite direction to the intermediate wall 16. In this way, first and second channels 34, 36 provide a helter skelter arrangement formed by the intermediate wall 16 and at least a lower part of the perimeter wall 14.

An entrance 44 to the first channel 34 is at the uppermost portion of the intermediate wall 16. A container 64, preferably being of circular lateral cross-section, such as a beverage tin, can and bottle is fed laterally onto the upper portion 66 of the intermediate wall 16. The container 64 rolls along the first channel 34, through the gap 38, and into the second channel 36, coming to rest against the perimeter wall 14 at or adjacent to the lowermost portion 68 of the lower wall portion 62. Further such containers 64 are then also inserted into the enclosure 32 in a similar manner.

The exit 46 of the enclosure 32 is at the lowermost portion 68 of the lower wall portion 62. As the lowermost container 64*a* is extracted laterally of the second channel 36, the trailing containers roll along the first and second channels 34, 36 leaving space at the upper portion 66 of the first channel 34. A new container can thus be inserted, typically for chilling.

Again, it is preferred that at least one indicator is provided marking the entrance 44 to the first channel 34. An indicator marking the exit 46 is also preferred.

The embankment portion may be utilised with or without the inventory indicators.

It is thus possible to provide a container organizer which chronologically organises containers thereon. In particular, it enables a method to be used which always presents the first introduced container to a user. In the case of use with a refrigeration device or unit, the first presented container will be the one that has been chilled for the longest amount of time, leaving no confusion as to which is the preferred container for use. Inventory indicators although a precise number of replacement containers to be selected and inserted. An embankment portion enables smoother sliding movement of the containers in the transition between the first and second channels.

The embodiments described above are provided by way of examples only, and various other modifications will be apparent to persons skilled in the field without departing from the scope of the invention as defined by the appended claims.

What is claimed is:

1. A beverage container organiser comprising a base element and a perimeter wall which extends from the base element, the base element and the perimeter wall defining an enclosure for the insertion of a plurality of containers, and an intermediate wall which divides the enclosure into first and second channels, the intermediate wall extending from the base element and being spaced from the perimeter wall at one end of the intermediate wall forming a space between the end of the intermediate wall and a back of the perimeter wall, wherein the said space is dimensioned to allow the said plurality of containers to pass between the first and second channels, and a plurality of inventory indicators provided as notches in upper edge portions of the perimeter wall, whereby as containers are moved along the first and second channels the inventory indicators indicate a number of replacement containers that can be inserted.

2. A beverage container organiser as claimed in claim 1, wherein at least the base element and perimeter wall are formed of a high thermally conductive material for promoting heat transfer between the said containers and the surroundings.

3. A beverage container organiser as claimed in claim 1, wherein the base element includes an embankment portion at the space between the end of the intermediate wall and the perimeter wall.

4. A beverage container organiser as claimed in claim 3, wherein the embankment portion extends from or adjacent to an end of the first channel to or adjacent to an end of the second channel.

5. A beverage container organiser as claimed in claim 3, wherein the embankment portion is curved in a direction from the first channel to the second channel.

6. A beverage container organiser as claimed in claim 1, further comprising at least one directional indicator indicating at least one of an entrance for a said container into the enclosure and an exit for a container from the enclosure.

7. A beverage container organiser as claimed in claim 1, wherein a portion of the perimeter wall defining the back is at least in part curved to promote the passage of a said container through the said space between the first and second channels.

8. A beverage container organiser as claimed in claim 1, wherein a height of the perimeter wall is greater than the said container, so that a plurality of container organisers is stackable.

* * * * *